United States Patent [19]

Bozung

[11] Patent Number: 4,471,682

[45] Date of Patent: Sep. 18, 1984

[54] AUTOMATIC CHORDING DEVICE FOR GUITARS AND SIMILIAR INSTRUMENTS

[76] Inventor: Richard E. Bozung, Rte. 1, Box 286, Mt. Pleasant, S.C. 29464

[21] Appl. No.: 356,391

[22] Filed: Mar. 9, 1982

[51] Int. Cl.[3] ..... G10D 3/00

[52] U.S. Cl. ..... 84/319

[58] Field of Search ..... 84/315-319

[56] References Cited

U.S. PATENT DOCUMENTS

| | | | |
|---|---|---|---|
| 222,111 | 9/1971 | De Masi . | |
| 1,168,153 | 1/1916 | Boswell . | |
| 1,280,959 | 10/1918 | Campton | 84/319 |
| 1,926,561 | 9/1933 | Schrickel . | |
| 2,021,641 | 11/1935 | Spina . | |
| 2,025,786 | 12/1935 | Spina | 84/319 |
| 2,026,354 | 12/1935 | Mihalek . | |
| 2,027,937 | 1/1936 | Schrickel | 84/319 |
| 2,461,232 | 2/1949 | Pulsifer | 84/319 |
| 2,746,337 | 5/1956 | Smit . | |
| 3,011,380 | 12/1961 | Brimhall . | |
| 3,227,028 | 1/1966 | Simms | 84/318 |
| 3,568,560 | 3/1971 | Chang . | |
| 3,822,629 | 7/1974 | Smith . | |
| 3,922,945 | 12/1975 | Pettijohn | 84/319 |
| 4,183,279 | 1/1980 | Shabram | 84/318 |

*Primary Examiner*—Lawrence R. Franklin

*Attorney, Agent, or Firm*—Parkhurst & Oliff

[57] ABSTRACT

A simple, efficient chording mechanism for instruments such as the guitar, banjo or mandolin, which is hand held, light weight and slides up and down the neck of the instrument stopping at any fret and assuming either of two basic lateral positions relative to the strings, and is either tilted forward, or held horizontal, thereby automatically producing major, dominant seventh, relative minor and relative minor seventh as well as the major sixth chords. At each fret a different chord family is produced. Said device has adjustable features which enable additional chords to be produced.

11 Claims, 15 Drawing Figures

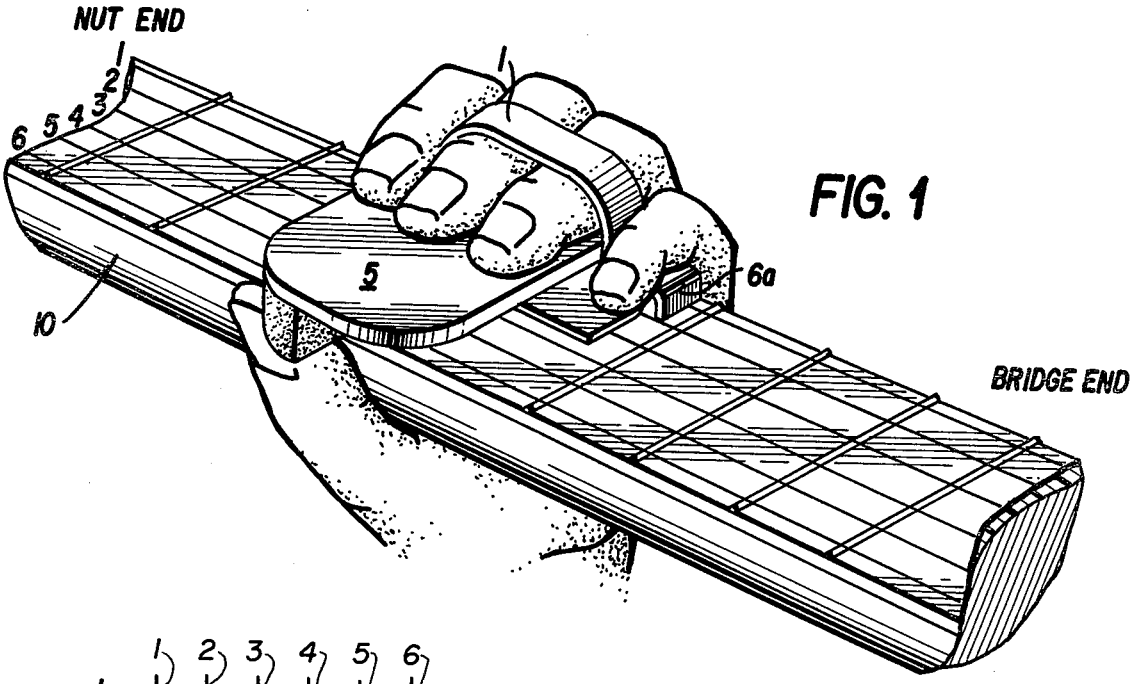
FIG. 1
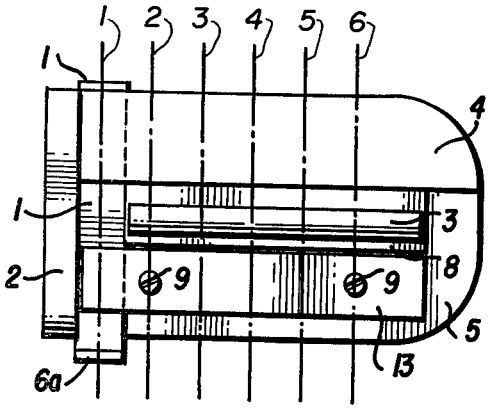
FIG. 2
FIG. 3
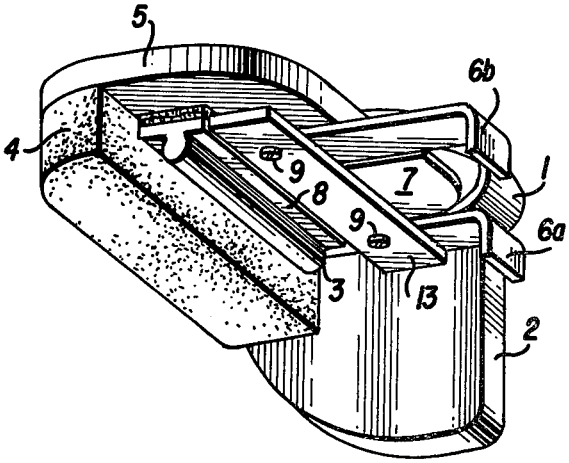
FIG. 4
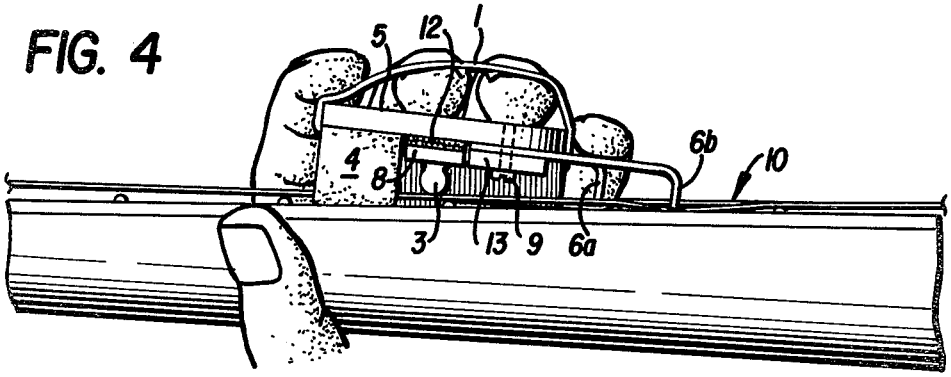

MODIFIED STANDARD TUNE MODE
1st POSITION 2/4

MODIFIED STANDARD TUNE MODE
2nd POSITION

OPEN TUNED

MODIFIED OPEN TUNED MODE
1st POSITION 3/4

MODIFIED OPEN TUNED MODE
3rd POSITION

MODIFIED OPEN TUNED MODE – 2nd POSITION

AUTOMATIC CHORDING DEVICE FOR GUITARS AND SIMILIAR INSTRUMENTS

BACKGROUND

The present invention relates to automatic chording devices for instruments such as the guitar, banjo or mandolin.

Previous attempts at developing automatic chording devices for the guitar and similar instruments have generally fallen into four different categories. This prior art is represented by the disclosure of the following U.S. patents: Pettijohn, U.S. Pat. No. 3,922,945; Chang, U.S. Pat. No. 3,568,560; Brimhall, U.S. Pat. No. 3,011,380; Spina, U.S. Pat. No. 2,025,786 and Schrickel, U.S. Pat. No. 2,027,937. The aforementioned categories are those designated by first, Pettijohn, second, Chang, third, Brimhall, and fourth, Spina and Schrickel.

Looking first at the PettiJohn design, this design is characteristic of chording devices which are attached to the hand, and consisting of a bar and several fingering pads. By virtue of the placement of the fingering pads and appropriate manipulation of the device at a given fret position, that is placement on the strings either laterally or at a right angle to the finger board axis or at some other angle to the finger board axis, the device allows chords to be formed. At a given fret location proper manipulation of the device will produce for a given key the major, minor sub-dominant and dominant chords found in that key. To produce other chords the device is moved to another fret position and similar families of chords are produced. Manual fingering is required in forming some of the chords, and because of differences between steel guitar and classical guitar, and different length fret boards, the device may not fit all styles of guitars because of the very critical spacings longitudinally and laterally among the bar and pads. The problems with this device are that manipulating it precisely to the proper position at each fret to reproduce the desired chords is almost as difficult as trying to finger the chords without a chording device. Also, one must develop some way of memorizing what chords are produced at each fret. Although at one fret location one can play the tonic dominant and some dominant chords for a given key, one cannot play any of the relative minor chords that normally would be played in the same key.

The second type of prior chording devices is characterized by Chang, and are attached to a modified guitar neck. At any one fret position, levers enable one to play a major, minor and dominant seventh chord and then, when shifted laterally, to play corresponding chords in the dominant family. As an example, at one fret position A, A minor, A seventh, and with a lateral shift E, E minor, E seventh, can be played by depressing appropriate levers. The disadvantage of such a device is that it requires a guitar to be modified, it is bulky, has a complicated structure, is extremely limited in terms of its chording versatility and is very inflexible in terms of its longitudinal movement along the neck.

The third type of prior chording devices are characterized by Brimhall, and those are mechanical devices securely fastened to the guitar, remaining in one position at all times, producing several basic chords. As an example, the Brimhall design produces twelve chords. Some such devices incorporate buttons, others utilize depressable bars. The limitation here is that only twelve chords can be produced and, one is dealing with an aesthetically bulky item which is very limited in terms of its practical use.

Finally, the fourth type of prior chording device is characterized by devices such as Spina and Schrickel, which are specifically to be used on so-called Hawaiian or opened-tuned guitars, which might commonly be tuned E, A, E, C sharp, E, and would typically be played with the guitar lying upon the lap, the left hand holding the chording device and sliding it along the neck of the instrument, with a bar or some device for depressing the strings against the frets, open chords being produced at each fret, different chords depending on the fret.

As previously noted, these devices are exclusively for use with the guitar supported face up on the lap of the player. Such devices have a leg or legs protruding forward or rearward to produce minor chords instead of a major chord. Typically, they produce not the relative minor but the minor chord of the major chord at that fret. For instance, at the fret producing a C major chord, proper lateral and rotational movement of the bar will produce a C minor chord. As demonstrated below herein, this is totally different from the present invention wherein the leg or legs or lateral adjustment of the device will produce a relative minor of the major chord produced at that particular fret. As an example, the C major chord and the A minor chord.

None of the prior art devices provide the kind of simplicity, flexibility, ease of use, or design approach and specific characteristics found in the present invention which is known as the Bozung design.

It is thus an object of this invention to overcome the defects of the above-discussed prior art.

It is also an object of this invention to provide a simple, efficient chording device for guitar, banjo, mandolin or the like.

It is a further object of this invention to provide a chording device which will automatically produce at a single fret position on a guitar-like instrument, major, dominant seventh, relative minor, and relative minor sevenths, as well as major sixth chords.

BRIEF DESCRIPTION

The inventive Bozung device is a hand held chording device consisting of a finger rest for two or more fingers, adjustable strap, guide, interchangable bars that may either be hard, soft, curved or flat, and which accomodate lateral adjustment of said bars, and an optional leg or legs which may be laterally and longitudinally adjustable and removable, and a dampening mechanism which is also easily removable. The Bozung device slides along a neck and contacts the strings to produce chords, and at a given fret produces a family of major and relative minor chords depending upon its position on the neck. In its preferred playing mode, two different and easily obtainable positions produce a major chord and its dominant seventh and a relative minor and minor seventh of the major chord; it also produces a major sixth which is the same as the relative minor seventh. At each fret the present invention produces a different family of major and relative minor chords. It produces a total of 60 chords in one embodiment which can be adjusted to produce twelve each of suspended, augmented and major seventh chords. With a dampening mechanism attached, when lifted off the strings it automatically dampens the strings, or can be used as a slide without a dampening mechanism attached. It is easily adjustable to fit instruments of varying scale lengths and/or string spacing, and in the preferred embodiment will fit almost any guitar-like instrument without adjustment. It is fully compatible with standard or open tuned guitars. In its preferred mode it is used with a modified open tuning on guitars, strings 1-6 tuned EBGBGD, respectively, with one short leg adjacent to the guide. It is also compatible with modified tuned banjos, mandolins, bass guitars and similar instruments, and compatible with acoustic or electrified instruments. With major and relative minor chords printed adjacent to the frets on the neck of an instrument, anyone can easily and comfortably play the most common chords without memorizing fingering positions or duplicating complicated fingerings. To operate one simply slides the bar to the fret corresponding to the chord desired, moves it laterally and/or tilts it forward to produce different chords of a family.

BRIEF DESCRIPTION OF THE DRAWINGS

The foregoing objects and others are provided by the present invention which is schematically illustrated in the accompanying drawings which are briefly described below:

FIG. 1 is a perspective view of a guitar being played with the present invention having one leg;

FIG. 2 is a bottom view of the present invention with one leg for play in a modified open tuned mode;

FIG. 3 is a side perspective view of the present invention with both legs in position for play in a standard tune or modified standard tune mode;

FIG. 4 is a side view of the present invention with legs attached, tilted forward and producing a relative minor chord on a modified standard tuned guitar;

DETAILED DESCRIPTION

Figure 5:
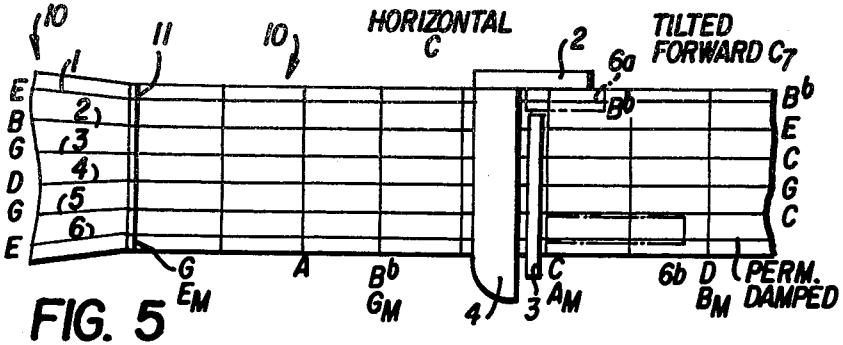
FIG. 5 is a diagram showing the basic position for forming a major chord and when the inventive device is tilted forward an X indicating that the first string is stopped down one fret with the short leg to produce the dominant seventh of the major chord in a modified standard tuned mode.

FIG. 1 shows an embodiment of the inventive hand held chording device secured to the hand by means of an adjustable strap 1 with finger rest 5, which, as shown in FIG. 2, also comprises an easily removable dampening mechanism 4 which is made of an easily compressible material such as open-celled foam with a slick surface to permit easy lateral and longitudinal movement of the dampener over the strings.

The dampener dampens the strings when the bar 3 is placed upon or removed from the strings, thereby minimizing feedback noise. The dampening mechanism also dampens those strings which are not barred while the device is being used. The bar is attached to a bar base 8. Said bar and base can be easily removed from the device and placed in any lateral position desired or interchanged with another bar base.

One way this can be accomplished is by attaching adhering surfaces such as Velcro 12 (see FIG. 4) to the underside of the bar base and the underside of the finger rest. The bar may be made of glass, wood, metal, or some compressible material such as vinyl plastic tubing or other material. Its surface for contacting the strings may be flat, curved or flexible. The device is designed so that different kinds of bars can be quickly and easily interchanged.

The device also consists of a guide 2 most clearly portrayed in FIG. 3. The guide has a smooth inner surface so that when placed against the neck of the instrument being played, it will slide smoothly along said neck, maintaining the bar at a right angle to the axis of the strings and maintaining the proper positioning of the bar and leg **6*a* or other legs relative to the strings 10. The device may optionally and additionally comprise one or two forward protruding legs 6*a* and 6*b*, or stops as shown in FIGS. 1 through 4**. Said leg or legs are either extended to stop a string down two frets below the barred fret, or retracted to stop a string down one fret below the barred fret and engage and stop a string when the device is tilted forward. The legs are positioned to accomplish the desired result anywhere between the first and eleventh fret. The legs may be fixed or be adjustable, both laterally and longitudinally, relative to the guide to fit the particular guitar or instrument being played.

A leg base 13 with screws 9, or similar means for loosening and tightening, holds the legs in place and facilitates quick and easy removal, replacement or adjustment of one or both legs. Additionally, there is an optional pinky finger rest 7, which like the legs, is adjustable, removable and secured to the device via screws 9 which attach to the leg base 13, which in turn, locks the legs and finger rest in place. The legs and finger rest are made of any suitable hard or semi-hard substance.

Figure 13:
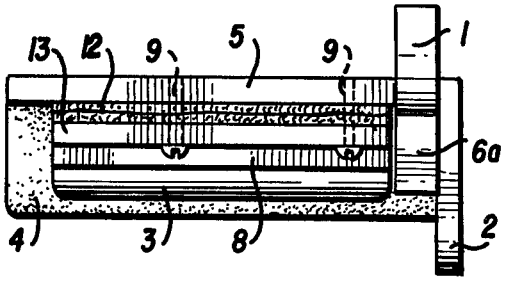
FIG. 13 is a front view of the inventive device in its preferred embodiment with one leg next to the guide.

FIG. 13 is a front view of the device with one leg **6*a* adjacent to the guide 2 and with the bar 8 positioned so that it will not contact the first string when the guide 2** is placed adjacent to the neck of the instrument being played.

Figure 11:
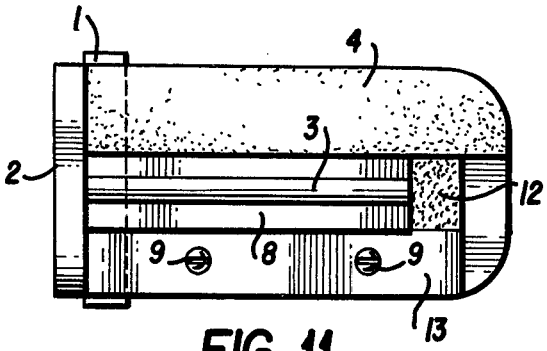
FIG. 11 is a bottom view of the inventive device with bar moved adjacent to the guide and no legs for playing an open tuned mode.

FIG. 11 is a bottom view of the device without legs and the bar moved from the position adjacent the guide. Here one can identify the exposed Velcro 12. The leg base is in place, and helps to support the bar base 8.

FIGS. 3 and 4 show the device with both legs in place, one retracted and one extended. They may, of course, both be retracted, extended, moved laterally, removed singularly or together or in any combination thereof, depending on the tuning of the instrument being played and the chords desired.

FIG. 2 is a bottom view of the configuration already described in FIG. 11. The legs are approximately three eighths inch wide and are designed to stop only one string at a time. When the device is held in a horizontal position so that the top of the finger rest is parallel to the plane of the strings, the dampener extends down below the bar, and the legs do not extend downs as far as the bar so that to engage legs and strings the device is tilted slightly forward.

The device is compact, durable and light in weight. In a simple setting the legs and bar will fit most any guitar, banjo or mandolin. The device can be made in one mode in which said legs or leg are fixed in position and still the device will fit most any instrument.

To produce the most commonly played chords, majors, minors, dominant sevenths and minor sevenths one configuration is required which may never have to be modified regardless of the instrument being played. To initially position the bar and legs, the bar in the preferred embodiment is placed about three eighths inch away from the guide and one leg **6*a* is positioned adjacent the guide, the tip of the leg extending out from the center line of the bar a distance of approximately, at the 11th fret, one fret spacing, or approximately three quarters of an inch. When tilted forward no matter what fret position is used between the first and twelth frets, the leg 6*a*** will stop the first string down one fret from the bar producing the dominant seventh chord of the major chord being produced at that barred fret.

Figure 7:
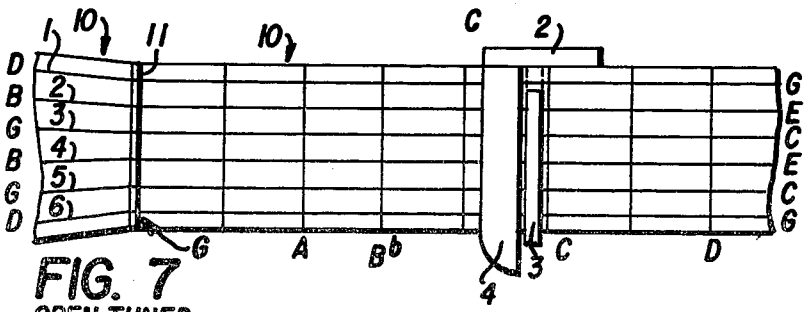
FIG. 7 is a diagram showing the bar of the inventive device moved adjacent to the guide and a major chord being formed in an open tuned mode.

In another configuration, with no legs and the bar moved adjacent the guide as in FIGS. 7 and 11, the device produces a different major chord at each fret on an open-tuned instrument. For example, at the fifth fret in a guitar, a C major chord is produced. At the right side of the fifth fret are indicated the notes produced by the barred strings at that fret. The tuning of the strings at the nut 11 are shown on the left. The major chords produced at each fret are indicated along the lower neck line. Observe that the guide is maintained adjacent the neck.

Figure 6:
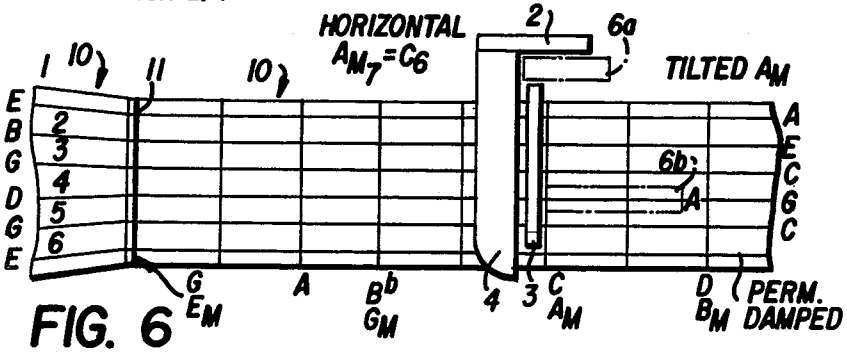
FIG. 6 is a diagram showing the basic position for forming the relative minor seventh chord of the major chord and when the inventive device is tilted forward, an X indicating that the fourth string is stopped down two frets with the long leg to produce the relative minor chord also in a modified standard tuned mode.
Figure 12:
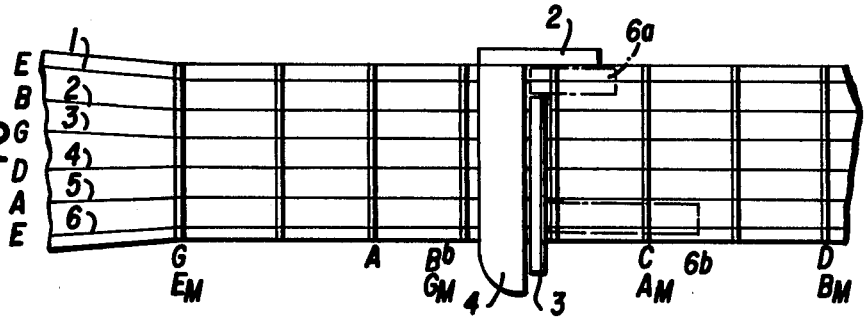
FIG. 12 is a diagram showing an embodiment of the device for use with a standard tuned guitar.

When using the device on a standard tuned guitar as shown in FIG. 12, or a modified standard tuned guitar as shown in FIGS. 5 and 6, both legs may be added as shown in FIGS. 1 and 3. The bar is moved about three eighths of an inch away from the guide, leg **6*a* placed adjacent the guide about three quarters of an inch from the bar and the other leg 6*b* is placed out over the #6 string extending about one and three quarters inches from the bar. For example, to produce a major chord in either of these tunings, the device is held horizontal or even tilted back as desired with the guide adjacent the neck. Thus again, at the fifth fret as shown in FIG. 5, a C major chord is produced. The sixth and possibly the fifth strings, depending on the tuning, are permanently dampened by inserting a small pad between the fret board and the string near the bottom end of the fret board. The first string is dampened by the dampening mechanism 4. The notes produced by the strings barred at fret 5 are indicated on each of the strings adjacent fret 5. If the device is then tilted forward, leg 6*a* engages the first string previously dampened and stops it down one fret below the bar producing a B flat note, therefore producing, when all the strings are strung, a $C_7$ chord. To produce the relative minor seventh chord $A_M7$, of the major chord at the fifth fret, the device is simply shifted laterally with the guide moved far enough away from the neck to allow the bar to contact the first string. To produce the minor chord instead of the minor seventh, the device is tilted forward so that the extended leg 6*b*** stops the fourth string down two frets below the bar. Once again, the notes produced by the bar and leg when tilted forward are indicated in the drawings.

FIG. 4 is a side view of the configuration of the device in forming the A minor chord. The retracted leg **6*a* is not contacting anything, and the extended leg 6*b* is stopping the fourth string down two frets from the bar. If it is desired to produce a major seventh chord instead of a dominant seventh chord, then the leg 6*a* is extended as 6*b* and the device positioned in the same manner as in making a dominant seventh chord. That is, the guide is against the neck pressed down on the strings and tilted forward so that leg 6*a* stops the first string down two frets from the bar. To properly locate the fret at which any given major or relative minor chord is formed, markings as indicated in FIG. 4**, can actually be affixed to the neck of the guitar for easy reference. With the device and the markings all commonly played chords can be reproduced without memorization or making complicated fingerings. Alteration of the position of the legs will produce other chords such as major sevenths, suspended and augmented chords if desired. In addition, the device can be used in barring any string at any fret for melody picking purposes.

Figure 8:
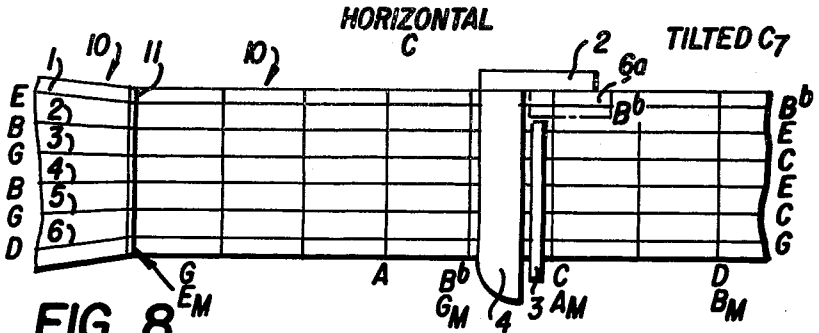
FIG. 8 is a diagram showing the positions of the inventive device to form a major and dominant seventh chord in the preferred configuration with one leg and modified open tuning.
Figure 9:
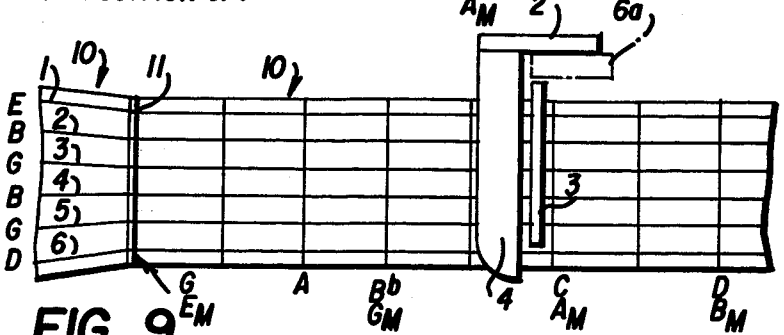
FIG. 9 is a diagram showing the position of the inventive device to form a relative minor chord in the preferred embodiment.
Figure 10:
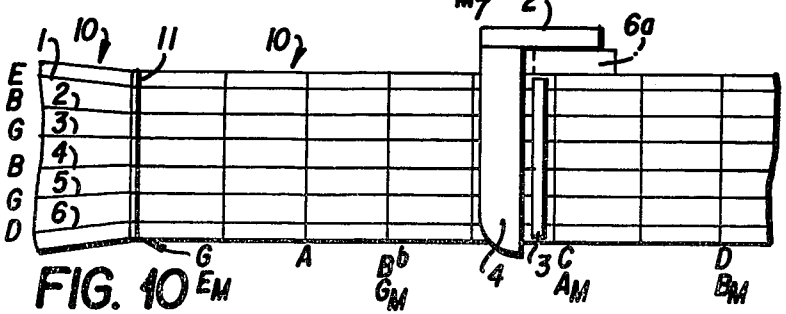
FIG. 10 is a diagram showing the position of the inventive device to form a relative minor seventh chord in the preferred embodiment.

In its preferred embodiment which corresponds to the modified open tune mode diagrammed in FIGS. 8–10, and shown in FIGS. 2 and 13, the device incorporates the bar moved far enough away from the guide so as not to contact the first string when the guide is adjacent the neck and one permanently fixed or, if adjustable, retracted leg **6*a*** against the guide as in the previous embodiment.

As shown in FIG. 8, the major and dominant seventh chords are formed in the same manner as before. The relative minor chord is produced by simply moving the bar laterally far enough so that it no longer contacts the sixth string, but instead the string is dampened by the dampening mechanism 4, which extends outward from the guide slightly beyond the bar. This is shown in FIG. 9.

The relative minor seventh chord illustrated in FIG. 10 is produced by moving the bar back to bar the sixth and first strings.

Figure 14:
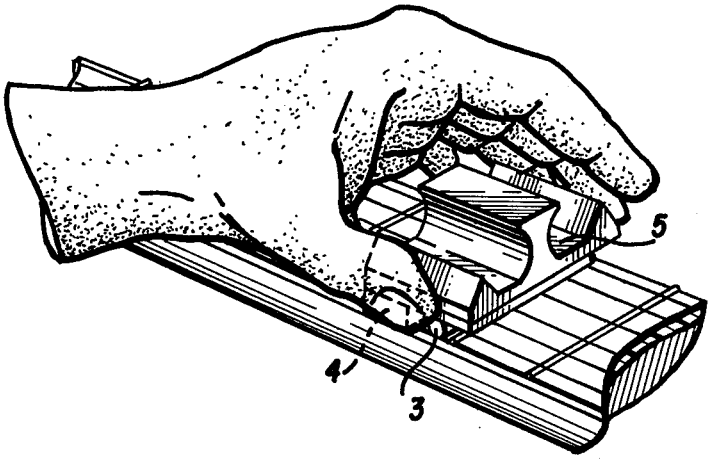
FIG. 14 is a perspective view of a simple embodiment of the device for use in lap play, without guide and legs, or strap, and with additional finger supports on top.
Figure 15:
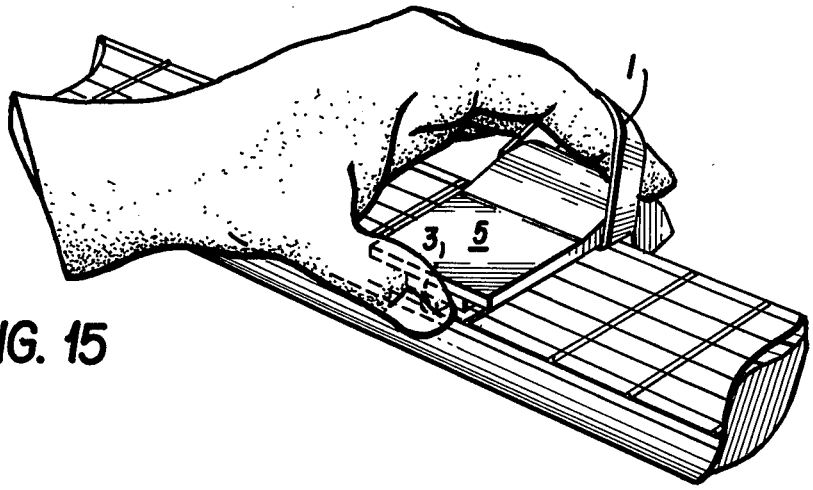
FIG. 15 is a perspective view of another embodiment of the device without legs, shown played in a lap playing mode, and with dampener removed, showing modified finger rest and guide shaped to the palm of the hand.

The simplest embodiment is a simple finger rest, with fixed or removable bar and dampener as pictured in FIG. 14. This is particularly suited for play when the instrument is supported in the lap. An embodiment of the device with finger rest, bar, guide, strap, but no legs and dampener removed is pictured in FIG. 15. Again this embodiment is shown being used in a lap play mode.

It is certainly feasible to produce the device wherein the one or two legs provided and/or the bar are fixed and have something that will work on practically all guitars. Additionally, the dampening mechanism may be secured to the bottom of the finger rest with an adherent material such as Velcro, so that it can be easily replaced or removed. The device may be made of plastic, wood, metal, or any other suitable material and incorporate Velcro, or closed cell foam padding, or any other materials which will produce the desired result. As already suggested, the legs can be placed in a variety of lateral positions relative to the device, and thereby create a variety of different chords, if desired. Suspended, augmented, diminished and major seventh chords are a sampling of the additional chords that can be produced given a particular lateral and longitudinal configuration of one or both legs. Additionally, when appropriate major and relative minor chords are labeled along the neck, chording any music becomes a relatively simple matter.

What is claimed is:

1. A hand held chording device for stringed instruments, comprising:

a base member, the upper face of which comprises a multiple finger pressure rest means;

a string depresser bar affixed to and extending across the lower face of the base member in a direction substantially perpendicular to an end of the base member;

dampening means for contacting the strings on an instrument being played with the device, said dampening means affixed to and extending across the lower face of the base member substantially parallel to the string depresser bar;

a strap extending over the finger pressure means of said device for retaining the device on multiple human fingers; and guide means at one end of the base member extending downwardly from the lower face of the base member and including a substantially flat surface adjacent the base.

2. The chording device of claim 1, wherein the string depresser bar is adjustably attached to said base.

3. The chording device of claim 1, wherein the damping means is removably attached to the base member.

4. A hand held chording device comprising: a base member, the upper face of which comprises a finger pressure rest means;

a string depresser bar affixed to and extending across the lower face of the base member in a direction substantially perpendicular to an end of the base member;

dampening means for contacting the strings on the instrument being played with the device, said dampening means affixed to and extending across the lower face of the base member substantially parallel to the string depresser bar;

at least one leg extending from the side of the base opposite that where the dampening means is located, said leg for depressing a string at a fret different from the fret at which said bar depresses multiple strings when said device is tilted in the direction said leg extends from the base; and guide means at one end of the base member extending downwardly from the lower face of the base member and including a substantially flat surface adjacent the base.

5. The chording device of claim 4, wherein there are at least two such legs, at least one of which may be laterally and longitudinally adjustable.

6. The chording device of claim 5, wherein at least one leg is removably attached to the base member.

7. The chording device of claim 4, wherein the string depresser bar is adjustably attached to said base.

8. The chording device of claim 4, wherein at least one leg is removably attached to the base member.

9. The chording device of claim 4, wherein the damping means is removably attached to the base member.

10. The chording device of claim 4, wherein said one leg is located immediately adjacent the guide means for depressing a string closest adjacent said guide means against the fret immediately below the fret at which said bar depresses multiple strings.

11. The chording device of claim 4 in combination with a six string guitar tuned E, B, G, B, G, D, respectively, on strings 1–6.

* * * * *